United States Patent [19]

Hultdin et al.

[11] 4,099,762

[45] Jul. 11, 1978

[54] GRIPPING DEVICE

[75] Inventors: Gustaf Matteus Hultdin; Ove Anders Hultdin, both of Malå, Sweden

[73] Assignee: Hultdins Verkstads AB, Malå, Sweden

[21] Appl. No.: 750,691

[22] Filed: Dec. 15, 1976

[30] Foreign Application Priority Data

Jan. 22, 1976 [SE] Sweden ..... 7600642

[51] Int. Cl.[2] ..... B66C 1/00

[52] U.S. Cl. ..... 294/88; 214/147 G; 294/86 R; 403/31

[58] Field of Search ..... 294/86 R, 88, 106; 37/182–188; 188/1 B, 321; 214/147 G, 651; 403/15, 31, 76, 83, 84, 90

[56] References Cited

U.S. PATENT DOCUMENTS

| | | | |
|---|---|---|---|
| 1,237,163 | 8/1917 | Brockett | 214/131 X |
| 3,493,135 | 2/1970 | Novotny | 214/147 G |
| 3,592,503 | 7/1971 | Lundberg | 294/86 R |
| 3,889,829 | 6/1975 | Dutton | 214/147 G |
| 3,895,694 | 7/1975 | Muntjanoff | 188/1 B X |
| 3,937,302 | 2/1976 | Palmcrantz | 188/1 B |
| 3,945,137 | 3/1976 | Ruttershoff | 214/147 G X |

FOREIGN PATENT DOCUMENTS

| | | | |
|---|---|---|---|
| 1,114,763 | 10/1961 | Fed. Rep. of Germany | 403/31 |

*Primary Examiner*—Johnny D. Cherry

[57] ABSTRACT

A gripping device comprising two pivotally mounted gripping claws is operated by a double acting hydraulic cylinder. The entire gripping device is pivotally mounted from a crane or the like by means of a universal joint. A member is provided which is operated on by a pressure fluid in the double acting hydraulic cylinder and which serves to temporarily lock the universal joint against pivotal movement to provide a secure and firm connection between the gripping claws and the crane or the like on which the claws are supported. In one embodiment of the invention a rod engages with a ball shaped head to prevent pivotal movement of the universal joint, and in a second embodiment bellows are inflated by hydraulic fluid to prevent movement of a pivotal joint.

25 Claims, 6 Drawing Figures

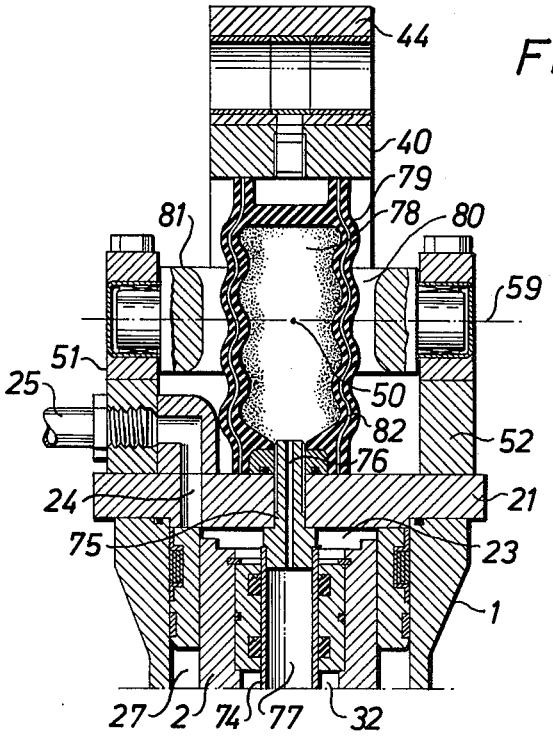
Fig. 4
Fig. 6
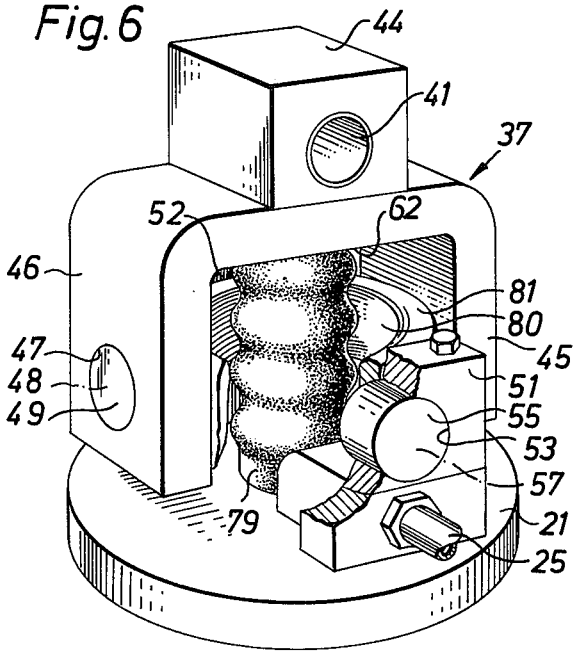

44
40
46
62
79
46
78
81
88
37
57
50
54
53
59
55
56
51
58
25
52
76
82
39
24
21
22
23
11
75
34
31
33
74
1
32
77
27
27
2
12
13
28
30
18
10
20
29
9
6
83
26
5
7
8
14
15
16
19
4
3
17

GRIPPING DEVICE

BACKGROUND OF THE INVENTION

The present invention relates to a gripping device and more particularly relates to a gripping device or other manipulating device of the type which is pivotally suspended from a crane and which is operated hydraulically or pneumatically by way of a pressure medium. In particular the invention relates to a gripping device which is operated by means of a double-acting hydraulic or pneumatic cylinder movement of a piston within the cylinder controlling two gripping claws which cooperate to form the gripping device. The gripping claws are pivotally mounted on or adjacent the hydraulic cylinder and the entire assembly of the gripping claws and the hydraulic cylinder is connected to a crane by way of a universal joint which permits pivotal movement on one or more axes.

The development of the hydraulic telescopic and/or folding arm crane has proved most useful in connection with the rapid and rational manipulation of various types of goods, and has thus contributed to making various transportation and supply operations more efficient. In order to minimise the strain and other stresses applied to he crane the gripping means is usually pivotally suspended from the crane or flexibly suspended. Often the joint member permits pivoting movement in all directions and is thus truly a universal joint, and in such gripping devices two or more joints may be provided having joint hinges permitting pivotal movement about axes that are at an angle to each other. In certain cases this flexible mounting of the gripping member is a advantage, for example where the reach of the device is to be extended. However, in certain cases the flexibility is a disadvantage in that it may be difficult to control the precise movements of the gripping claws and consequently it is desirable to provide a gripping device in which it is possible instantaneously to stiffen the pivotal connecting joints in order to obtain better control of the gripping claws.

OBJECT OF THE INVENTION

The object of the present invention is to provide a device to enable a pivotal joint suspending a gripping device to be temporarily and instantaneously stiffened.

BRIEF SUMMARY OF THE INVENTION

The present invention provides a gripping device or the like which is pivotally suspended from a crane and which is operated by means of a pressure medium, that is to say is operated hydraulically or pneumatically. The device is provided with a hydraulic or pneumatic power transmission member incorporating a piston rod, linear movements of the piston rod being transferred to pivotably journalled gripping claws. This assembly is connected to a crane or the like by way of a pivotal joint which permits pivotal movement about one or more axes. In accordance with the invention means are provided for temporarily, instantaneously stiffening the joint between the crane and the rest of the gripping device. In one embodiment of the invention a rod is provided which can be moved in response to high pressure in existence in either of the two chambers of the double-acting hydraulic piston, the rod being adapted to engage with another member to lock the universal joint. In a second embodiment of the invention a set of bellows are provided which are adapted to expand and high pressure hydraulic fluid is supplied thereto, the expanded bellows being adapted to engage a part of the universal joint to prevent further pivotal movement of the universal joint.

It is envisaged that embodiments of the invention may be found to be useful particularly in connection with the loading and unloading of timber. At the present time when timber is felled logs are collected adjacent roads running through the woods or forest. Sometime the logs are merely individual logs, although sometimes the logs are in the form of piles or heaps. Subsequently the logs have to be lifted onto the load carrying area of a lorry or truck or the like, and it is during this lifting operation that a hydraulic telescopic and/or folding arm crane provided with a gripping device in accordance with the present invention may be found to be most useful. Subsequently the timber is graded and it is during such processes that the ability to control the gripping device present on a crane accurately and consistently is of importance. It is to be noted that the manipulation of timber constitutes between 40 and 60 per cent of the work in the transportation of the timber from the wood or forest to the saw mill, and it is envisaged that preferred embodiments of the invention will facilitate such manipulation of timber. A crane provided with a gripping device in accordance with the invention will also be extremely useful for gripping stumps present in the ground when trees have been felled, since stumps are now removed from the ground and are utilised.

Hereinafter preferred embodiments of the invention are described in detail, but it is to be understood that embodiments in accordance with the spirit and scope of the invention can be designed in many ways in order to achieve the desired temporary stiffening of the joints connecting gripping claws to a crane or the like. Stiffening may be obtained, for example, by means of mechanical locking or hydraulically by means of the stiffening effect achieved upon increased pressure in rubber elements or other elastic elements. In the latter case the desired stiffening can be obtained by means of one or more hoses applied parallel to the suspension joints, or by means of an elastic casing surrounding the entire suspension joint. The latter also provides efficient lubrication of the movable parts in the joint.

BRIEF DESCRIPTION DRAWINGS

In order that the invention may be more readily understood, and so that further features thereof may be appreciated, the invention will now be described, by way of example, with reference to the accompanying drawings in which:

FIG. 1 is a side view, partially in section, of a portion of an apparatus in accordance with the invention, FIG. 2 is a side view, partially in section, of the apparatus of FIG. 1 with the piston rod and gripping claws in an alternative position, FIG. 3 is a perspective view of the upper section of the apparatus illustrated in FIGS. 1 and 2, FIG. 4 is a side view, partially in section, of a portion of an apparatus in accordance with the second embodiment of the invention, FIG. 5 is a side view, partially in section, of the apparatus illustrated in FIG. 4 with the stiffening member thereof activated, and FIG. 6 is a perspective view of the upper section of the gripping device illustrated in FIGS. 4 and 5.

DETAILED DESCRIPTION OF PREFERRED EMBODIMENTS OF THE INVENTION

Figure 1:
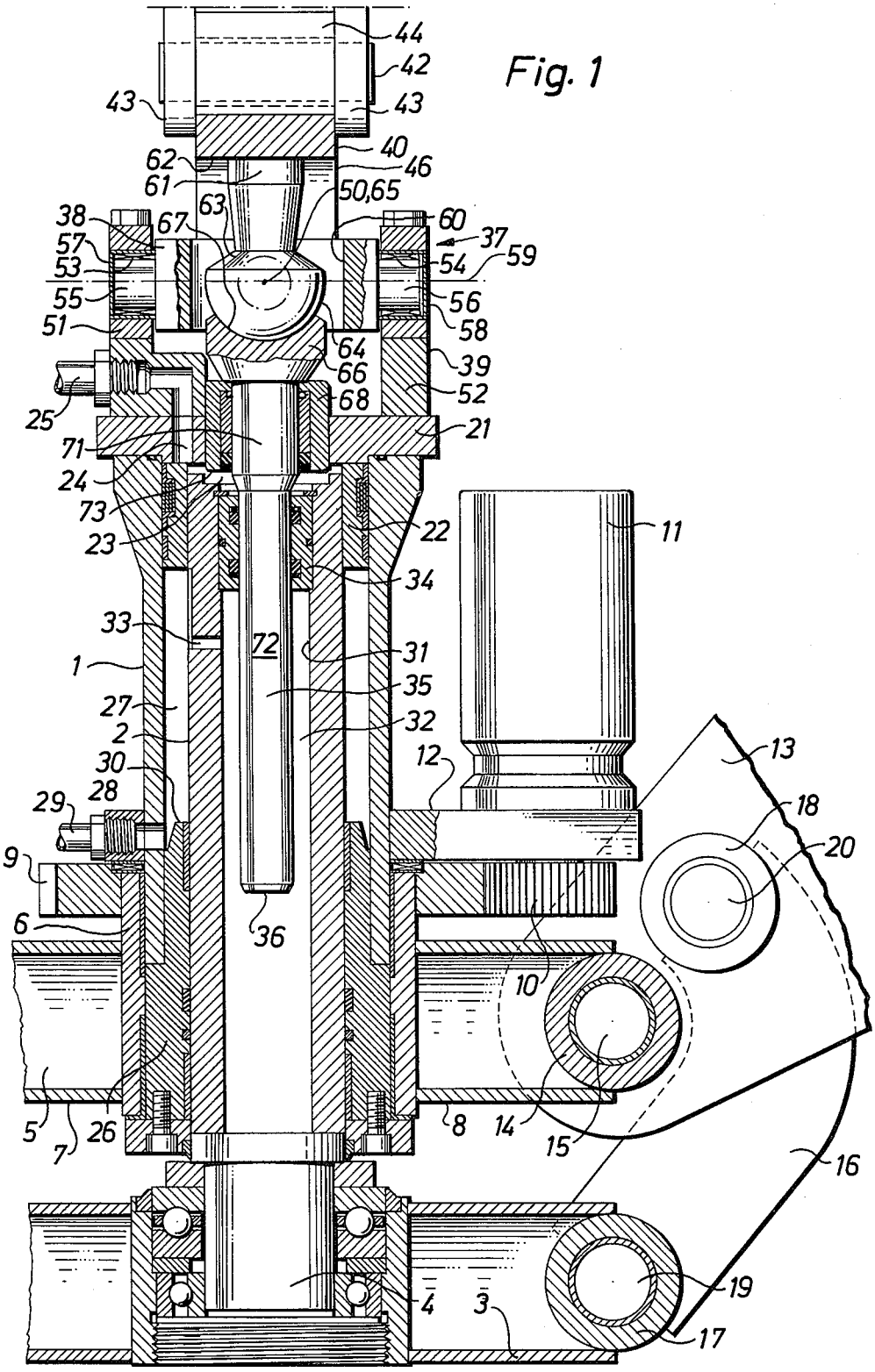
Figure 2:
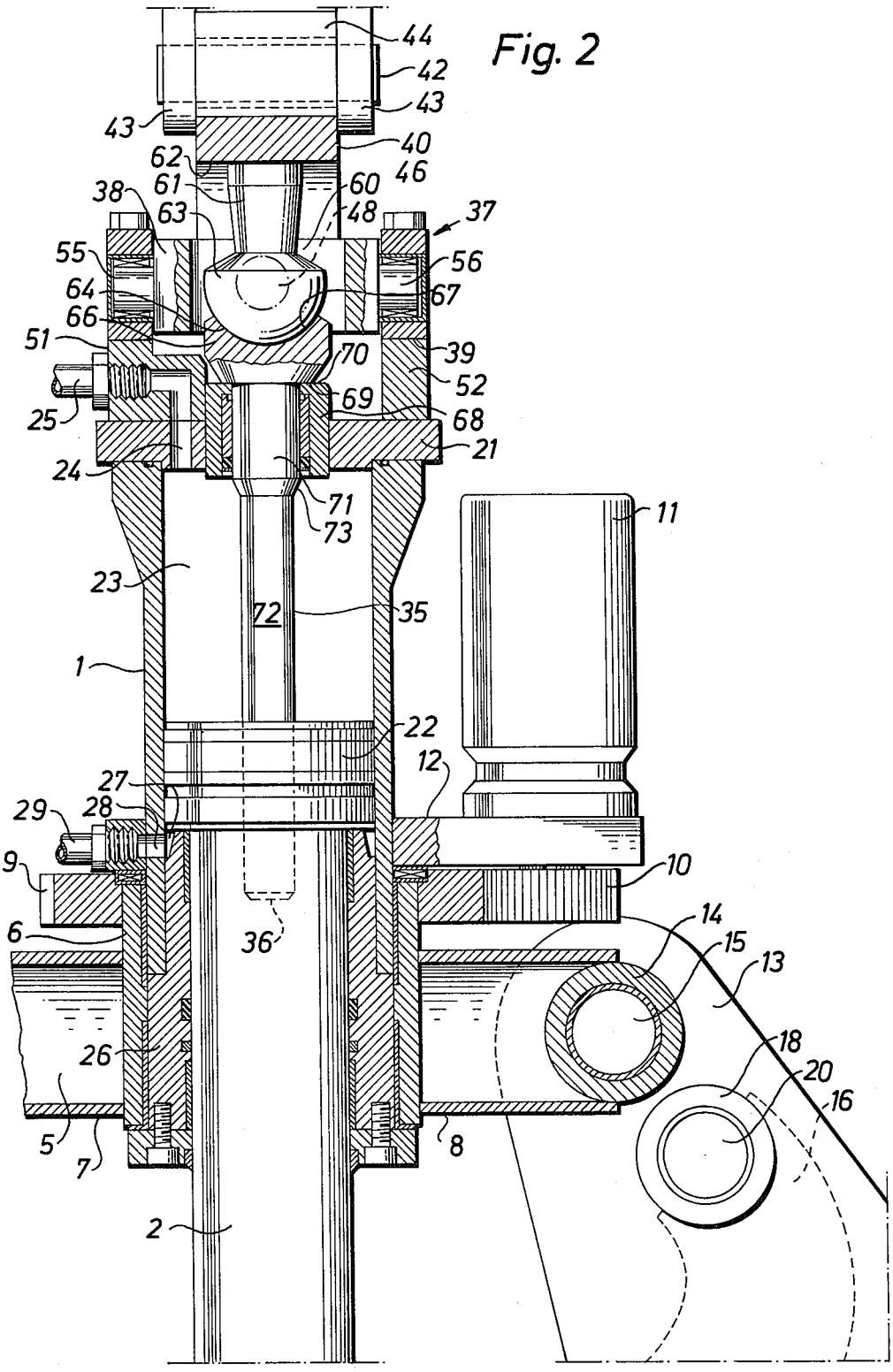
Figure 3:
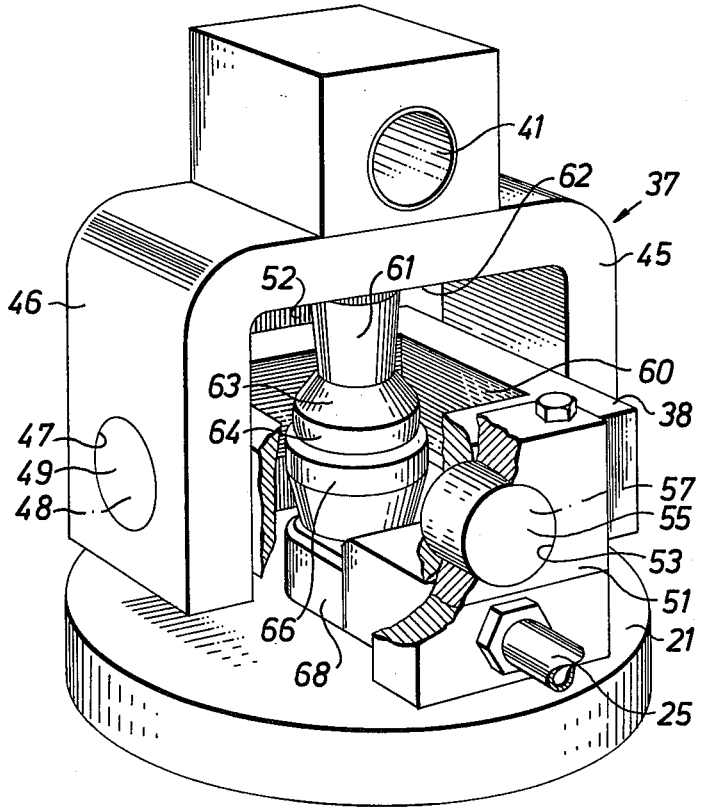

Referring to FIGS. 1 to 3, the first embodiment of the invention comprises an apparatus including a gripping device and having a power transmission member for actuating the claws of the gripping device and comprising a double-acting hydraulic cylinder 1 which is vertically positioned, there being a piston provided within the cylinder 1 having a downwardly protruding piston rod 2 terminating at its lower end with a horizontal cross piece 3. The cross piece 3 is pivotably journalled about the lower end 4 of the rod 2 by means which are not shown in detail in the drawings. For example, a further extension may be provided for the end piece 4 which co-operates with a retaining nut, and in such a case the illustrated bearing may be covered by means of a threaded lid which is screwed into the illustrated threaded opening in the cross piece 3.

A support member 5 comprising a sleeve section 6 and two diametrically opposed horizontally extending supporting elements 7, 8 is pivotally mounted about the lower end of the hydraulic cylinder 1. The sleeve section 6 is provided with a toothed rim at the top thereof which engages a toothed wheel 10 on a rotating shaft associated with a hydraulic motor 11 which is carried by a support plate 12 secured to the hydraulic cylinder 1. The hydraulic motor 11 is supplied with a working medium, preferably hydraulic oil, through one of two hydraulic supply pipes (not shown) depending upon the desired direction of rotation for the supporting member 5 which is rotatably journalled on the hydraulic cylinder 1.

The illustrated apparatus includes two gripping claws 13, which are movable relative to one another and which may be of any suitable shape or construction. For the sake of simplicity only the upper part of one such claw is shown in the drawing.

The gripping claws are pivotably mounted at opposite ends of the support elements 7, 8 by means of bushings 14 and bearing pins 15. The lower end of piston rod 2 is connected to the gripping claws by means of a link system so that linear movement of the piston rod becomes a pincer-like movement of the claws. The link system comprises link arms 16 pivotally supported at opposite ends of the cross pieces 3 by means of bushing 17 and bearing pin 19 and also pivotally connected to the claws 13 by means of a bushing 18 and a bearing pin 20. The bearing pin 20 is close to a bearing pin 15 and bush 14 which pivotally support the claw 13 on the support element. In the apparatus illustrated the gripping claws 13 are completely open, i.e. are moved away from each other, when the piston rod is fully drawn up into the cylinder 1, as illustrated in FIG. 1, whereas the grip is fully closed, i.e. the claws are moved together, when the piston rod protrudes fully from the cylinder 1 as illustrated in FIG. 2. Irrespective of their position the claws can be rotated about the axis of the hydraulic cylinder by activating the hydraulic motor 11 to drive the toothed rim 9 and thus the support elements for the gripping claws in the desired direction.

The hydraulic cylinder 1 is closed at the top by an annular lid 21 which defines an upper hydraulic pressure chamber 23 adjacent the upper end of the piston rod which is provided with a piston head 22. The chamber 23 is connected via a channel 24 in the lid 21 to a conduit 25 for the supply and withdrawal of hydraulic oil to move the piston head 22. The hydraulic cylinder is closed at its lower end by a sleeve 26 which is welded to the hydraulic cylinder 1 and forms an extension thereof in the region of the support member 5. The piston rod 2 passes through the sleeve 26, and a suitable seals are provided to prevent hydraulic fluid escaping. The piston head 22 is provided with peripheral sealing elements to seal against the inner walls of the cylinder 1 and defines between itself and the sleeve 26 a lower pressure chamber 27 which is provided with a channel 28 passing through the cylinder 1 and leading to a conduit 29 for the supply and withdrawal of hydraulic oil. The sleeve 26 forms a seat 30 for the piston head 22 at the full stroke of the cylinder, as shown in FIG 2.

The piston rod 2 is itself hollow and is provided with an axial bore which forms a central chamber 32 which communicates with the lower pressure chamber 27 via a radial bore 33 in the wall of the piston rod 2. (several such bores may be provided if so desired). Consequently the pressure in the chamber 32 can be regulated, i.e. the same pressure can be obtained in the chamber 32 as the pressure obtained in the chamber 27. The pressure chamber 32 is sealed at the bottom end thereof by the end piece 4 which is welded to the piston rod 2 and is closed at the top thereof by means of a sleeve element 34 which is integrally formed with the piston rod 2. The sleeve 34 has a central axial bore through which an elongated pressure rod 35 extends into the pressure chamber 32, appropriate seals being provided to prevent the escape of hydraulic fluid from the chamber 32. The pressure developed by the hydraulic fluid can act on the free end 36 of the pressure rod 35 as will be described hereinafter in greater detail.

A link joint 37 is integrally formed with or connected to the hydraulic cylinder above the lid 21. The link joint comprises a universal joint, that is to say a joint that will permit pivotal movement in two perpendicular directions. The universal joint comprises a central junction member 38 which is in the form of a portion of square sectioned tube. The junction member 38 is pivotally connected to a stand 39 which is secured to the annular lid 21, and is also pivotally connected to a second stand 40 which is in the form of a fork having two downwardly extending prongs 45, 46, the prongs being interconnected by a cross piece provided with an upper protuberance 44 which is provided with a horizontal aperture 41 adapted to receive a bearing pin 42 when the apparatus is suspended from the arm of a crane. The pair of downwardly directed lugs 43 provided on the arm of the crane receive the protuberance 44 between them and also engage the bearing pin 42. The gripping device can thus turn freely about the bearing pin 42.

The two prongs 45, 46 of the fork 40 are provided with bores 47 which are aligned with each other to receive bearing pins 48 protruding from the junction member 38, the pins being covered by covers 49. As can be seen from the accompanying drawing the bores 47 in the fork and the bearing pins 48 of the junction member lie on a first axis of pivotal movement 50.

The first stand member 39 comprises two vertical plates 51, 52 which extend upwardly from the lid 21 of the hydraulic cylinder on either side of the fork 40. The plates 51, 52 are provided with co-aligned bores 53, 54 which receive bearing pins 55, 56 protruding from the junction member 38, each pin being covered by a cover 57, 58 respectively. As can be seen from the drawing the bores 53, 54 and the pins 55, 56 lie on a second axis of pivotal movement 59 which is perpendicular to the axis 50.

As described above, the junction member 38 has a central opening which is square, but it is to be appreciated that the central opening 60 may have any appropriate shape. A vertical rod 61 extends between the prongs 45, 46 of the fork 40 and is secured to the horizontal surface 62 of the connection piece 44. The rod 61 terminates at its lower end in a ball-shaped bearing head 63 having a downwardly directed spherical or globular contact surface 64. The radial centre 65 of the ball 63 coincides or substantially coincides with the intersection point of the axes 50 and 59, which is substantially the centre of the junction piece 38.

The pressure rod 35 described above terminates, at its upper end with a bowl-shaped head 66 having a recessed surface 67 facing the ball-shaped head 63 of the rod 61, the surface 67 having the same or substantially the same shape as the contact surface 64 of the ball-shaped head 63. The bowl-shaped head may have a tempered sliding surface or be made of bearing metal, although other materials may be utilised.

The pressure rod 35 is slidably mounted in a sleeve 68 which is sealingly arranged in a central opening in the lid 21 of the hydraulic cylinder. Suitable sealing elements provide sealing between the pressure rod 35 and the sleeve 68 to prevent the escape of hydraulic fluid. The bowl-shaped head 66 of the pressure rod is also provided with a lower annular shoulder 69 which is arranged to about against an upper seat surface 70 of the sleeve 68 so that downward movement of the pressure rod is limited by this contact between the shoulder 69 and the seat surface 70. Downward movement of the pressure rod may be slight, perhaps about 1 mm.

The cylindrical pressure rod 35 has an upper section 71 of one diameter and a lower section 72 which is of lesser diameter than the section 71 so that there is an annular inclined surface 73 connecting these sections which may be angled downwardly as shown in the drawings or flat, i.e. horizontal so that it forms approximately a right angle with the surfaces of the sections 71, 72. The annular surface 73 is arranged to be located in the upper pressure chamber 23 so that it can be influenced by pressure from the hydraulic oil in this chamber when desired.

As mentioned above, the movement of the pressure rod 35 is slight in relation to the ball-shaped head 63 and need not be greater than the movement necessary to ensure that the locking action between the ball-shaped head 63 and head 66 ceases when no pressure is applied to the free end of the pressure rod or the annular surface 73. Thus it will be appreciated that the surface 67 has sliding contact with the contact surface 64 when no pressure is applied to the rod 35, but when pressure is applied the surface 67 is urged against the contact surface 64, to prevent any further movement of the ball-shaped head 63, and thus to prevent any movement occurring in the link joint 37.

In operation of the above described apparatus in order to open the claws 13 of the gripping device hydraulic oil is pumped into the pressure chamber 27 via conduit 29 and channel 28, pressure thus being applied to the piston head 22 forcing the piston rod upwardly to a position where the gripping claws 13 are in fully raised or fully opened position, as is illustrated in FIG. 1. Since the gripping claws do not experience any great resistance to such movement there will be no great hydraulic pressure exerted on the free end 36 of the pressure rod 35 during this opening operation. However, when the piston head has reached the upper end of its movement and engages with the under surface of the annular lid 21, if the pressure of hydraulic oil supplied through conduit 29 is increased, increased hydraulic pressure will be exerted, through bore 33, to the chamber 32 and thus a relatively high pressure may be exerted on the pressure rod 35, thus forcing the rod upwardly so that surface 67 of the ball-shaped head 66 is brought into contact with the contact surface 64 of the ball-shaped head 63, providing a frictional force between the head 66 and the ball-shaped head 63 to prevent any further swinging movement of the link joint 37. Thus pivotal movement about the axis 50 and about the axis 59 is prevented.

A similar temporary and controllable stiffening of the link joint 37 can be obtained when the gripping device is in the closed position and the piston rod is in its lower end position as illustrated in FIG. 2. This condition is achieved by providing hydraulic oil under pressure through the conduit 25, thus forcing the piston head 22 downwardly and causing hydraulic oil to be ejected through the conduit 29. This causes the claws 13 to close and as the piston head 22 moves downwardly the bore 33 is sealed as the open end of the bore passes within the sleeve 26. Pressure from the oil pumped into the upper pressure chamber 23 will then act on the annular slanting surface 73 of the pressure rod 35 and when the claws have been fully closed, or when the claws have gripped an incompressible object, the pressure of oil supplied to the chamber 23 may be increased to such an extent that the pressure of oil acting on the slanting surface 73 forces the pressure rod upwardly so that the cup-shaped head engages the ball-shaped head 63 to stiffen the link joint.

It will, of course, be appreciated that the ball-shaped head 63 may be mounted on the rod 35 and the cup-shaped recess may be formed on the rod 61, and of course it will be appreciated that whilst these particular shaped heads have been described heads of other differing shapes may also be utilised if desired.

Figure 5:
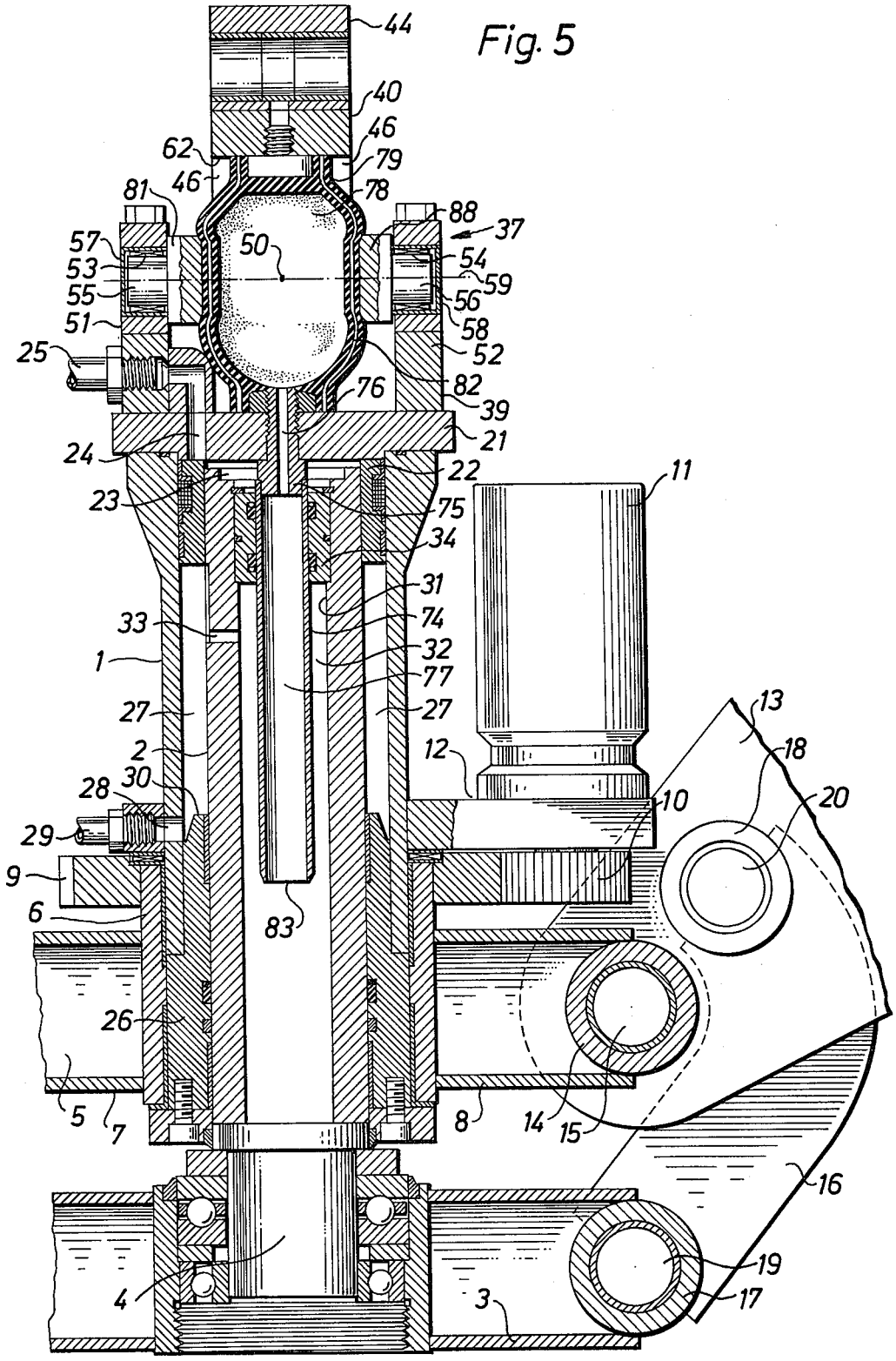

A second embodiment of the invention is illustrated in FIGS. 4 to 6 of the accompanying drawings, and in this embodiment of the invention many parts correspond directly with parts present in the above described embodiment of the invention. In these cases like reference numerals have been used and, for the sake of simplicity, a detailed description of these parts will not be provided since the operation of these parts will be readily described from the foregoing description of the first preferred embodiment of the invention.

It will be noted that in this embodiment of the invention the pressure rod and the stationary rod provided with the ball and cup-shaped heads have been replaced by different members to obtain the desired selective stiffening of the link joint 37. These members comprise a hollow pipe 74 extending axially within the hydraulic cylinder 1 and provided with a nipple 75 which extends through the lid 21 of the hydraulic cylinder to connecting the inner space 77 of pipe 74 to the inner space 78 of a tubular bellows arrangement 79 via a channel 76. The bellows arrangement 79 is provided within a central bore 80 provided in a junction member 81. The junction member 81 is similar to junction member 38 described above so that the junction member 81 is cylindrical and is provided with a central cylindrical bore 80. The bellows 79 is clamped at the ends between the lid 21 and the lower surface 62 of the fork 40. The bellows consists of a rubber material and is provided with an internal reinforcement 82. Parts of the bellows are vulcanized or otherwise sealed to the metal surfaces of the lid and the fork.

The hollow pipe 74 is open at its lower end to communicate with the inner pressure chamber 32 present within the piston rod 2, this inner chamber in turn communicating with a lower pressure chamber 27 via the bore 33 in the wall of the piston rod. When hydraulic oil is pumped into the lower pressure chamber 27 in operation of the device, hydraulic fluid is also provided under pressure to the bellows and when movement of the piston head 22 ceases the pressure within the bellows can be raised to such an extent that the bellows expand laterally to be brought into contact with the wall of the bore 80 in the junction member 81, thus stiffening the link joint 37 and preventing pivotal movement about the axis 50 or about the axis 59.

The embodiment of the invention illustrated in FIGS. 4 to 6 can be modified further by providing a communication to the inside of the bellows in the form of a nipple having two channels or a three way channel, for instance, joining the bellows to all three pressure chambers. In this case, non-return valves can be arranged in a suitable manner in these channels in order to prevent hydraulic fluid from being transferred under pressure from one pressure chamber to another through the bellows. In another modification of the invention the pipe 74 may be removed and the nipple 75 shortened somewhat so that connection is only provided between the bellows and the upper pressure chamber of the hydraulic cylinder. In this case the piston rod may be replaced by a solid rod, or at least be sealed in the upper region thereof.

In the above described embodiments of the invention when the joint 37 is stiffened whilst pivotal movement about the axes 50 and 59 is prevented it is still possible for the pivotal movement to occur about the axis of the pin 42. However, it is advantageous to be able to prevent any oscillations of the gripping claws 13 relative to the crane and such a joint can be provided by modifying the embodiment illustrated in FIG. 1 by making the rod 61 an axially movable rod, the rod extending upwardly through an appropriate aperture provided in the fork 40 or being connected to an extension which is arranged to cooperate with the bearing pin 42 to prevent rotation about the bearing pin 42 when the pressure rod 35 is moved upwardly by a sufficient extent.

Thus, when sufficient pressure is exerted on a rod 35 the rod will move upardly firstly to prevent any pivotal rotation about axes 50,59 and secondly to prevent any rotation about the axis of pin 42.

It will be understood that in such an embodiment of the invention the upper part of the pin 61, or the extension thereof, may act directly on the bearing pin or may act on the bearing pin by means of an intermediate ball and bowl member similar to that illustrated in FIG. 1. A corresponding stiffening of the upper joint provided with the support pin 42 can be achieved in the embodiment illustrated in FIGS. 4 to 6 by providing an axially movable pressure element, for example in the form of a dowel or rod which contacts the bellows at one end which moves in response to an increase of pressure within the bellows so that the other end thereof is urged against the bearing pin 42 or against a connection piece secured to the bearing pin which, together with the pressure element forms a ball and bowl member of the type generally described above.

It will be appreciated that in the described embodiments of the invention it is possible to effect a separate control of the movement of the piston rod and of the stiffening of the joint. In the embodiment illustrated in FIGS. 4 to 6 pressure medium can be introduced into the bellows through a separate channel provided in the lid 21, for example, in which case the communication between the bellows and the hydraulic cylinder may be eliminated and the piston rod can be replaced by a solid rod. Similarly the pipe 74 may also be eliminated. In the embodiment according to FIG. 1 this independent control can also be achieved, for example, by providing a separate pressure chamber in the upper section of the hydraulic cylinder, or in a separate section above the hydraulic cylinder which can be connected to a source of hydraulic fluid, the pressure rod for stiffening the joint member having its free end or other pressure activated surface in this separate pressure chamber so that the pressure rod can be pressed against the ball-shaped head 63 as described above in response to hydraulic fluid being provided to this separate chamber. In both cases, therefore, a stiffening of the joint can be achieved when so desired irrespective of the position of the piston rod utilised to operate the gripping device, and thus stiffening of the joint member and movement of the gripping claws may be effected by separate controls.

The embodiments of the invention as above described are particularly intended for use in connection with a crane or the like having a hydraulic telescopic and/or folding arm such as is used for loading and unloading timber from lorries or trucks, or for handling timber. However, it is to be understood that the present invention can also be used for gripping devices for dealing with loose material such as earth or chippings where the gripping claws combine to form a scoop. It is to be understood that the expression "gripping device" and "gripping claws" shall be considered to have a broad meaning and shall not be limited merely to gripping claws intended primarily for handling timber.

Finally it is to be understood that whilst the power transmission member has been illustrated as being a vertically orientated hydraulic cylinder, the power transmission member may be horizontally located if desired.

What is claimed is:

1. Apparatus comprising a gripping device, having claws for holding material, pressure medium actuated means to move said claws including at least one pressure chamber, and a pivotal joint to suspend said device including means for instantaneously stiffening the said pivotal joint temporarily to prevent pivotal movement thereof on actuation of said claws, a pressure rod, means to subject said pressure rod to pressure from said pressure medium from said at least one pressure chamber, a support facing the pressure rod and with which said pressure rod engages to instantaneously stiffen said joint, said pivotal joint comprising a first stand member, a junction member pivotally connected to the first stand member, a second stand member pivotally connected to the junction member, a support member extending from the second stand member, said junction member defining a central opening through which the support member extends, the support member cooperating with the pressure rod.

2. A gripping device as claimed in claim 1 wherein said pivotal joint permits pivotal movement about two axes and wherein movement about both said axes is prevented when the joint is instantaneously stiffened.

3. A gripping device according to claim 1 wherein the movement of the gripping claws and stiffening of the joint member can be effected independently of each other.

4. A gripping device according to claim 1 wherein the support member is rigidly secured to said second stand member.

5. A gripping device according to claim 1 wherein the pivotal joint includes an upper pivotal support pin, the support member having limited axial movement in relation to said second stand member and being adapted to cooperate with an upper locking pin to stiffen pivotal movement about the upper locking pin simultaneously with the stiffening of the remainder of the joint.

6. A gripping device as claimed in claim 5 wherein the support member consists of a rod, a spherical head provided on the rod having a spherical surface, and wherein the pressure rod has a head having a spherical bowl-shaped surface for abutment against the spherical head.

7. A gripping device as claimed in claim 1 wherein the support member and the pressure rod have spherically shaped cooperating contact surfaces.

8. Apparatus comprising a gripping device having gripping claws for holding material, said gripping claws being actuated by a double-acting hydraulic piston having upper and lower pressure chambers, a pressure rod protruding into said upper and lower pressure chambers and having an annular surface which is subjected to pressure in the upper pressure chamber and a narrower section that is subjected to pressure within a second pressure chamber that is in communication with the lower pressure chamber, and a pivotal joint for suspending said gripping device comprising means for instantaneously stiffening the said pivotal joint temporarily to prevent pivotal movement thereof on actuation of said claws, said means subjecting said pressure rod to pressure from said pressure medium from at least one pressure chamber, and a support facing the pressure rod and with which said pressure rod engages to instantaneously stiffen said joint.

9. A gripping device as claimed in claim 8 wherein the stiffening means comprises at least one elastic element which is arranged to cooperate with the joint in order to stiffen it under the influence of a pressure medium.

10. A gripping device as claimed in claim 9 wherein the elastic element consists of cylindrical shaped bellows which are arranged to expand peripherally in lateral direction to abut against at least part of the joint when pressure medium is supplied to the bellows.

11. A gripping device as claimed in claim 10 wherein pressure medium is supplied to the bellows from a pressure chamber utilised to move said gripping claws.

12. Gripping apparatus adapted for suspension pivotably from a crane or the like comprising:

a cylinder having at least one pressure chamber therein;

means for admitting pressurized fluid into and for discharging said fluid from said chamber;

a piston reciprocable in said chamber under the influence of said fluid;

a piston rod connected to said piston for movement therewith;

a pair of claws carried pivotably by said cylinder and operatively connected to said piston rod for pivotal movement into and out of gripping position responsive to movement thereof;

a joint for pivotably supporting the gripping apparatus on the crane or a member associated therewith including a junction member adapted to pivotably support the cylinder for pivotal movement about at least one axis and a bearing member extending from said crane or associated member;

and joint immobilizing means responsive to the pressure within said pressure chamber and movable thereby to engage said bearing member to thereby immobilize said joint.

13. Gripping apparatus according to claim 12 wherein said joint immobilizing means comprises a pressure rod mounted slidably in said cylinder having at least one portion thereof exposed to the fluid pressure in said chamber and having another portion thereof engageable with said bearing member.

14. Gripping apparatus according to claim 13, including first support means secured fixedly relative to said cylinder, said junction member being journaled pivotably in said first support means, said associated member being second support means carried pivotably by said junction member, said bearing member extending from said second support means and being engageable by said pressure rod within a central opening defined by said junction member.

15. Gripping apparatus according to claim 14, wherein said pressure rod terminates at one end thereof externally of said cylinder in a bowl-shaped head having an arcuate recess therein, said bearing member having the extremity thereof formed with a surface complementary with said recess.

16. Gripping apparatus according to claim 14, wherein said junction member is carried by said first support means for pivotal movement about an axis perpendicular to the longitudinal axis of said cylinder and said second support means is pivotably carried by said junction member for movement about an axis in the same plane as and perpendicular to the pivotal axis of said junction member.

17. Gripping apparatus according to claim 16, wherein said junction member comprises a peripherally extending member and said second support means comprises an inverted substantially U-shaped fork member, the legs of said fork member straddling said junction member and being journaled on pivot pins carried by said junction member.

18. Gripping apparatus according to claim 13, wherein said cylinder is a double acting cylinder having first and second pressure chambers disposed on opposite sides of said piston, said pressure rod having a first portion exposed to the fluid within a first of said chambers so as to be movable to immobilize the joint when the said claws are in gripping position and a second portion exposed to pressurized fluid within the second chamber so as to be movable to immobilize the joint when said claws are in non-gripping position.

19. Gripping apparatus according to claim 12, wherein said joint immobilizing means comprises said bearing member which is elastic and is movable into engagement with said junction member.

20. Gripping apparatus according to claim 19, wherein said elastic member is a bellows, conduit means being provided for communicating the interior of said bellows with said chamber.

21. Gripping apparatus according to claim 20, wherein said junction member comprises a peripherally extending member, first support means being secured fixedly relative to said cylinder, said junction member being journaled pivotably in said first support means, said associated members being an inverted substantially U-shaped fork member the legs of which straddle said junction member and are journaled pivotably on pivot pins carried by said junction member, said bellows extending between the portion of said fork member connecting the legs and said cylinder within said junction member, said bellows being expandable laterally into engagement with the inner surface of said junction member.

22. Gripping apparatus adapted for suspension pivotably from a crane or the like comprising:

means for pivotably carrying a pair of gripping claws;

at least one pressure chamber and means for admitting a pressurized fluid into and for discharging fluid from said chamber;

means for moving said claws into and out of gripping position under the influence of the pressurized fluid within said chamber;

a joint for pivotably supporting the gripping apparatus on the crane or a member associated therewith and including a first support member secured fixedly relative to said claw-carrying means, a junction member carried pivotably by said first support member and defining a central opening therein, and a second support member carried pivotably by said junction member;

a bearing member extending from said second support member through the central opening in said junction member;

and a pressure rod having at least a portion thereof extending into said pressure chamber to be exposed to the pressurized fluid therein, said pressure rod being movable in response to predetermined fluid pressure within the chamber into engagement with said bearing member to thereby immobilize the joint.

23. Gripping apparatus according to claim 22, wherein said bearing member and said pressure rod are provided with complementary engaging surfaces.

24. Gripping apparatus according to claim 23, wherein said engaging surfaces are arcuate.

25. Gripping apparatus according to claim 22, including a double-acting cylinder having first and second pressure chambers, said pressure rod extending into both of said chambers and having one section thereof exposed to the fluid pressure in one of said pressure chambers and another section exposed to the fluid pressure in the other of said pressure chambers.

* * * * *